United States Patent [19]

Alheid

[11] 4,405,661

[45] Sep. 20, 1983

[54] BLADE TYPE FOUNTAIN COATER AND METHOD

[75] Inventor: Robert J. Alheid, Beloit, Wis.

[73] Assignee: Beloit Corporation, Beloit, Wis.

[21] Appl. No.: 301,111

[22] Filed: Sep. 10, 1981

[51] Int. Cl.[3] ..... B05D 3/12; B05C 5/02

[52] U.S. Cl. ..... 427/356; 118/410; 118/413

[58] Field of Search ..... 118/407, 410, 413, 126, 118/411; 427/356, 358, 355

[56] References Cited

U.S. PATENT DOCUMENTS

| | | | |
|---|---|---|---|
| 1,484,705 | 10/1921 | Frothingham et al. | 118/407 X |
| 3,131,092 | 4/1964 | Coghill | 118/413 |
| 3,348,526 | 10/1967 | Neubauer | 118/410 |
| 3,882,817 | 5/1975 | Zink | 118/126 |
| 4,250,211 | 2/1981 | Damrau et al. | 427/356 |
| 4,340,011 | 7/1982 | Wahren et al. | 118/413 X |

*Primary Examiner*—John P. McIntosh

*Attorney, Agent, or Firm*—Hill, Van Santen, Steadman & Simpson

[57] ABSTRACT

A fountain type web coating applicator and method wherein flow of coating material from source to a doctor blade coating nip with the continuously travelling web is subjected to a plurality of successive pressure drops so that coating material reaches the coating nip uniformly throughout the extent of the doctor blade edge. One of the pressure drops is through a multi-port pressure drop device and another pressure drop is through a slit orifice pressure drop device. A novel arrangement for easy replacement clamping of the doctor blade is provided. A doctor blade thruster is adjustable up and down along the blade relative to the upper coating nip edge of the blade.

20 Claims, 4 Drawing Figures

BLADE TYPE FOUNTAIN COATER AND METHOD

This invention relates to improvements in apparatus and method for coating webs, and is more particularly directed to blade type fountain coaters especially suitable for applying coating materials to paper webs.

Coating apparatus of the type with which the present invention is concerned is particularly adapted for so-called short-dwell coating, attaining maximum transfer of coating material from a suspension onto the surface of a continuously running web, with minimum soaking of the material into the body of the web. Basic principles of such apparatus have been disclosed in Neubauer U.S. Pat. No. 3,348,526. According to that patent, which is incorporated herein by reference for a more detailed explanation of the underlying principles, coating material is supplied to and along a coating nip of a generally upwardly projecting doctor blade extending across the width of a web travelling continuously on backing surface means such as a roll.

A more recent Damrau et al U.S. Pat. No. 4,250,211 discloses various alleged improvements on the apparatus first disclosed in the aforesaid U.S. Pat. No. 3,348,526.

However, the disclosures of both of the identified U.S. patents fail to provide any means for attaining uniformity of coating application entirely across the web. At least with certain types of coating, streaking is a distinct liability in the operation of the prior apparatus. There is also a problem related to attaining optimum coating nip adjustment of the doctor blade. Also, improvement is desirable in mounting of the blade.

It is therefore an important object of the present invention to overcome certain disadvantages, drawbacks, inefficiencies, shortcomings and problems inherent in prior web coaters of the type indicated.

To this end, the present invention provides in a fountain coating applicator especially suitable for paper web coating and including a generally upwardly projecting doctor blade having an upper edge for coating nip relation across the width of a web travelling continuously on backing surface means, means for delivering coating material, and means extending across the width of the web for supplying the coating material from the delivery means to the nip, various improvements comprising:

1. An arrangement for attaining uniform application of the coating material and including devices for subjecting the coating material to a plurality of successive pressure drops between the delivering means and the coating nip, and which may comprise a first chamber for receiving the coating material from the delivering means, a second chamber having multi-port pressure drop communication with the first chamber and thereby attaining substantially uniform distribution of the coating material across the web width, and a third chamber having slit orifice pressure drop communication with the second chamber, the arrangement being adapted for presenting the coating material substantially uniformly to the coating nip.

2. An arrangement for loading the blade toward the coating nip comprising a thruster extending along the width of the blade, and means mounting the thruster enabling adjustment of the thruster up and down along the blade and relative to the upper edge of the blade.

3. An arrangement which simplifies and improves mounting of the blade including a pair of clamping members, shoulder means on one of said members for receiving the lower edge of the doctor blade, complementary clamping surfaces on the clamping members above the shoulder means, and means relatively pivotally mounting the clamping members for separable but positive clamping cooperation of the members for firmly gripping and retaining the doctor blade by and between the clamping surfaces.

According to another aspect, the invention provides a method of coating a web travelling continuously on backing surface means, comprising controlling flow of coating material from delivering means to a coating nip and including subjecting the coating material to a plurality of successive pressure drops, which may be accomplished by delivering coating material to a first chamber of a fountain coating applicator, effecting multi-port pressure drop flow of the coating material from the first chamber into a second chamber and thereby attaining substantially uniform distribution of the coating material in the second chamber, and effecting a pressure drop of the coating material through a slit orifice into a third chamber and therein presenting the coating material substantially uniformly to the coating nip at the upper edge of a doctor blade extending across the width of the travelling web.

Other objects, features and advantages of the invention will be readily apparent from the following description of a certain representative embodiment thereof, taken in conjunction with the accompanying sheets of drawings, although variations and modifications may be effected without departing from the spirit and scope of the novel concepts embodied in the disclosure, and in which.

A blade type fountain coater apparatus 5 is adapted to be properly related for applying coating material as a suspension to a web W such as paper travelling continuously on backing surface means conveniently in the form of a backup roll 7 which preferably has an elastic perimeter. Journal means 8 rotatably support the roll 7 in a machine frame 9, and suitable means (not shown) drive the roll at a desirable peripheral speed.

Figure 3:
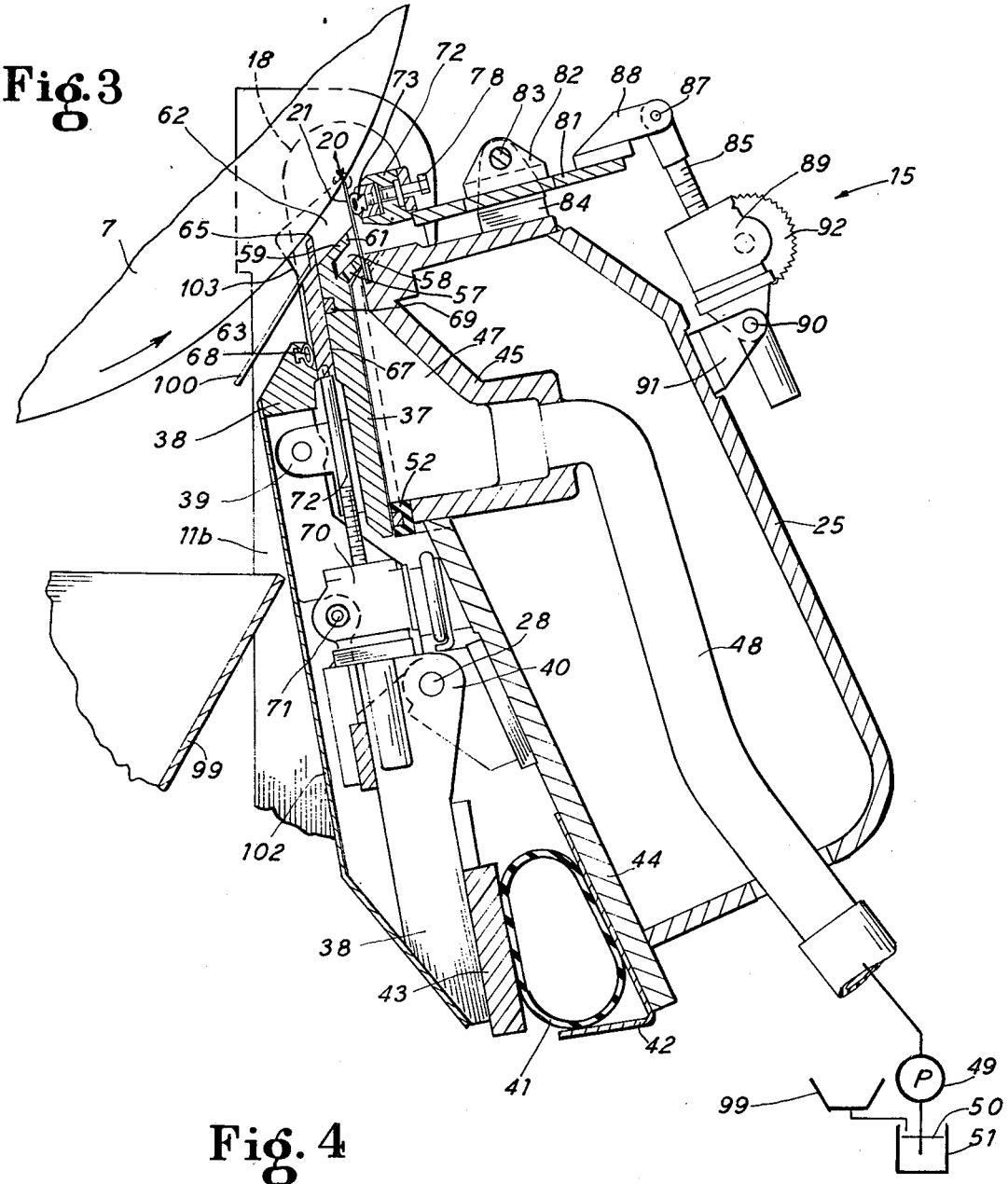
FIG. 3 is a vertical sectional detail view through the coating applicator head of the apparatus.

Mounting of the coater 5 is on a base 10 to which an upstanding coater frame 11 is mounted by pivot means 12, and airspring means 13 thrust upwardly under rocker arm means 14 integral with the lower part of the frame 11 and adapted to maintain the upper part of the frame 11, carrying a coater head structure 15, in a desirable adjusted relation to the lower portion of the uprunning side of the backing roll 7. An adjustable stop 17 carried by the machine frame 9 acts to adjustably fix an optimum primary adjustment of the coater relative to the roll 7, and more particularly the web W travelling therewith, at the critical coating zone. It will be understood that the coater frame 11 comprises a pair of upstanding frame portions 11*a* (FIG. 1) and 11*b* (FIG. 3) spaced apart to clear the opposite ends of the roll 7.

In a preferred arrangement, the coater head 15 is mounted on and between the frame portions 11*a* and 11*b* by means of a pair of depending substantially dogleg-shaped swingably adjustable support side arms 18 which at upper ends thereof are respectively connected by aligned axes pivot means 19 to the inner sides of the respectively associated coater frame portions 11*a* and 11*b*. As shown, the axes of the pivots 19 are desirably oriented by adjustment of the coater frame 11 to be aligned with a coating nip 20 defined in cooperation with the roll 7 by the upper edge of an upwardly projecting resiliently flexible doctor blade 21 of the coater head 15. At their lower ends, the arms 18 have rearward extensions 22 to which are connected repective adjustable links 23 which extend diagonally downwardly toward and are connected to the coater frame members 11*a* and 11*b* and are provided with servo motor means 24 by which adjustments of the coater head 15 are adapted to be made relative to the coater frame 11.

Figure 1:
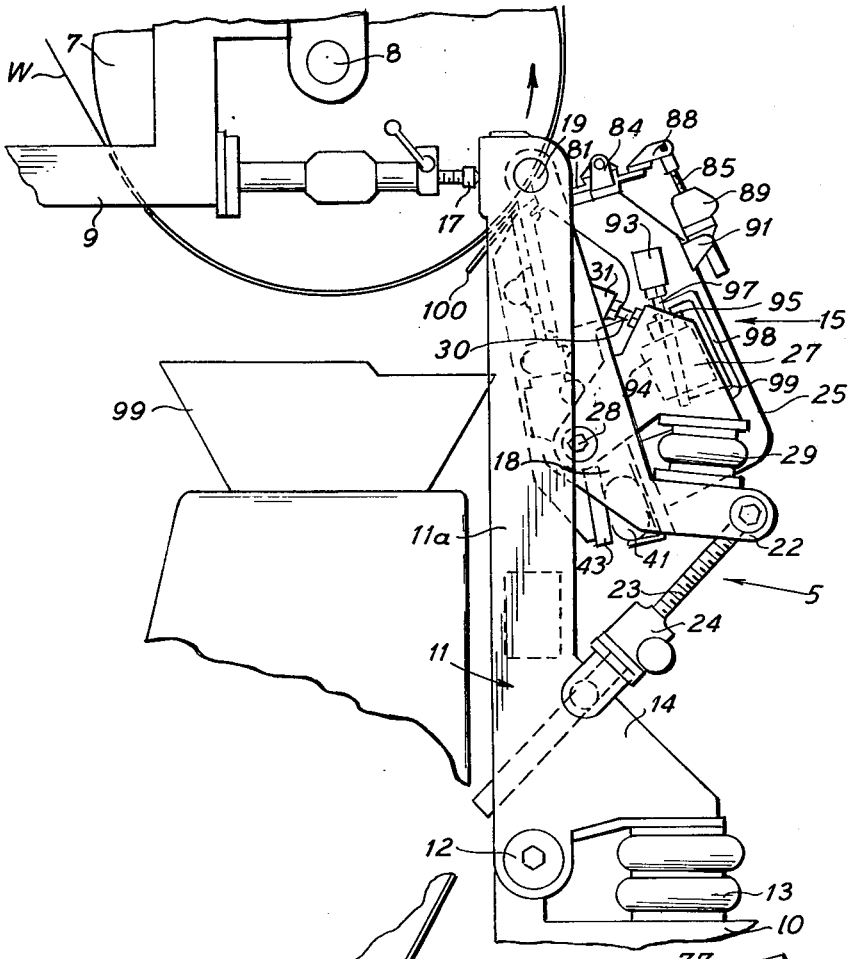
FIG. 1 is a fragmentary, and more or less schematic, illustrative side elevational view of a coating apparatus embodying the invention.

The coater head 15, comprises a hollow rigid beam body 25 preferrably of a length at least equal to the length of the roll 7. Means for adjustably mounting the body 25 on and between the arms 18 comprise a pair of side arms 27, only one of which is shown in FIG. 1, but there being a duplicate at the opposite side of the body 25. Forwardly projecting portions of the arms 27 are attached by pivot means 28 to the respective inner sides of the side arms 18, and thereby swinging adjustments of the head 15 toward and away from the coating nip relation to the roll 7 are adapted to be effected. For adjustment of the beam body 25 about the pivot 28, air spring means 29 are mounted on the arm extensions 22 and engage under rearwardly extending portions of the arms 27. Adjustable stop means 30 between upper portions of the arms 27 and suitable abutment means 31 on the respectively adjacent support arms 18 maintain a desired yieldable operating adjustment of the body 25 about the pivot means 28.

Improved means are provided for releasably securing the doctor blade 21 in the coater head 15, and more particulary mounting the blade in respect to the coater head body 25. To this end, as best visualized in FIGS. 2 and 3, the upper portion of the body 25 nearest the coating area is provided with shoulder means comprising a generally upwardly facing ledge-like shoulder 32 on which the lower edge of the blade 21 rests, with an upstanding lip 33 spaced from the adjacent portion of the body 25 and defining therewith a socket groove within which the lower edge portion of the blade 21 is retained freely but against any substantial lateral displacement. From the shoulder 32, the blade 21 projects upwardly past a blade clamping surface 34 on the member 25 spaced substantially above the shoulder 32 and the top of the lip 33 and providing an area of substantial width and at least as long as the length of the blade and against which the contiguous face of the blade is engageable in an area well below the longitudinal center line of the blade so that the blade is adapted for at least a limited range of resilient flexing movement about a fulcrum at the top of the clamping surface 34. Because of its upstanding location, the doctor blade 21 is sometimes referred to as an inverted blade.

A blade clamping surface 35 complementary to and cooperative with the clamping surface 34 is provided by a means of a clamping member plate 37 which is mounted in such manner that the member 25 and the plate 37 can be separated from one another for ready access to the doctor blade mounting for assembling or replacing the doctor blade 21. Support for the plate 37 is provided by means of an arm member 38 to which the plate 37 is attached by clevis means 39. Mounting of the arm 38 in association with the body member 25 is effected by ear means 40 integral with the arm 38 and pivotally mounted on the pivot or shaft means 28. Opening and closing of the clamping plate 37 relative to the body member 25 is controlled by means of an inflatable tube 41 supported by a holder 42 and acting between a shoulder 43 on the arm 38 and a wall surface 44 on the body 25. In the deflated condition of the tube 41, the lower portion of the body member 25 swings gravitationally toward the lower portion of the arm 38 by virtue of the eccentric disposition of the pivot 28, and thereby the upper portions of the arm 38 and the member 25 swing apart away from one another into a gap relationship enabling access to the doctor blade mounting. Inflation of the tube 41 swings the parts in the opposite direction, thereby effect clamping engagement of the clamping surfaces 34 and 35 against the doctor blade 21. It will be appreciated that the mounting of the plate 37 by means of the clevis structure 39 permits self-aligning of the plate 37 relative to the member 25 for optimum doctor blade clamping effect.

Another important attribute of the plate 37 is to provide means for attaining presentation of coating material substantially uniformly to the coating nip 20. To this end, the plate 37 cooperates with a chambered structure 45 in the upper front portion of the body 25 to form a front closure panel for a coating material supply chamber 47 to which coating material is delivered as by means of a duct 48 which communicates with a pump 49 which furnishes coating material 50 from a supply source 51 through the duct 48 into the chamber 47 under desirable operating pressure. Leakage from the chamber 47 past the plate 37 is avoided by suitable sealing means 52 at joint surfaces except at the clamping surface 35 where clamping pressure provides adequate sealing for the intended purposes.

Figure 4:
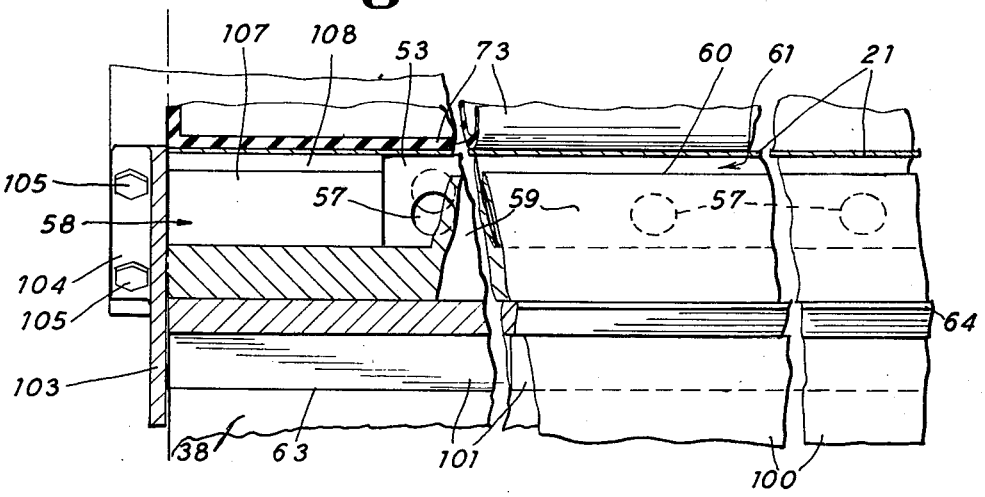
FIG. 4 is a fragmentary sectional elevational detail view taken substantially along the irregular section line IV—IV of FIG. 2.

Along its top edge, the plate 37 provides means for effecting uniform distribution of coating material across the width of the web W. To this end, the upper end portion of the plate 37 has a lip flange 53 providing a partition which extends toward the clamping surface 34 of the member 25 and provides the clamping surface 35. Thereby the flange 53 also serves as spacer means between the plate 37 and a surface 54 on the member 25 at the top of the chambered portion 45. This defines a slot-like passage 55 along the length of the blade 21, which, in effect, is closed along the top by the lip flange 53. Desirable turbulence as well as uniformity of distribution of the material is attained by providing the lip flange 53 with a spaced coating material is attained by providing the lip flange 53 with a spaced series of ports 57 (FIGS. 2, 3 and 4) located at preferably uniformly spaced intervals substantially throughout the length of the lip flange 53. Through this multi-port arrangement, pressure drop communication is effected between the chamber 47 by way of the passage 55 with a second chamber 58 defined between the lip flange 53 and an overhanging lip flange 59 on the upper edge of the plate 37. An edge surface 60 along the tip of the flange 59 is located in suitably spaced relation to the doctor blade 21 to define with the confronting surface of the blade a pressure drop orifice 61 providing communication between the chamber 58 and a third, coating application chamber 62 defined by and between the top of the flange 59, the overlying portion of web W and the doctor blade 21. It will be understood that the slit-like orifice 61 extends along the length of the blade 21 and spaced a suitable distance below the nip 20. A desirable pressure drop ratio from the first chamber 47 to the third chamber 62 may be such that the pressure drop is by about one half in the second chamber 58 compared to the pressure in the chamber 47, and then the pressure in the third chamber 62 is about one half the pressure in the second chamber 58. This succession of pressure drops attains thorough distibution and uniformity of coating material in the coating application chamber 62 and thus presentation of the coating material from the orifice 61 along the surface of the blade 21 to the nip 21 for optimum coating results throughout the length of the coating nip 20.

For maintaining adequate coating material pressure in the chamber 62, adjustable metering means are provided in the form of a metering plate 63 having an upwardly projecting metering tip 64 defining a spillway orifice 65 between the tip and the overlying web W. It will be understood, of course, that the plate 63 extends along the effective length of the coating material application chamber 62. Mounting of the spillway orifice plate 63 is desirably effected slidably in a slideway 67 (FIG. 3) defined between the adjacent back of the plate 37 and the upper portion of the arm 38. An inflateable tubular member 68 carried by the arm 38 impresses the spillway plate 63 into sliding engagement with the plate 37. Leakage through the joint between the plates 37 and 63 is avoided by means of a sealing strip 69 extending therealong.

For readily adjusting the plate 63 for controlling the metering spillway orifice 65, means comprising a servo motor 70 having pivotal connection 71 with the arm 38 is selectively operative to reciprocatably act through rod or shaft means 72 fixedly attached to the lower edge of the plate 63. Thereby reasonably accurate desired width adjustment of the orifice 65 by adjustments of the plate 63 are attainable.

For optimum coating material application, the applicator nip 20 must be accurately controlled and maintained. To this end, fine adjustment means are provided comprising a pneumatic thruster 73 which is of a length substantially the same as and engages against that face of the doctor blade 21 which is outside of the coating material application chamber 62. In addition to pneumatic adjustments by controlling air pressure supplied from suitable source (not shown) within the thruster tube 73, means are provided for mounting the tube 73 for general adjustment toward the blade 21, comprising a mounting bar 74 reciprocatably slidably carried in a guide channel 75 defined by an elongate head member 77. Adjustments of the mounting bar 74 are effected by means of a plurality of adjustment screws 78 located at spaced intervals along the length of the head 77. The screws 78 are retained against axial displacement by means of collars 79 and are engaged in tapped bores 80 in the bar 74. Thereby general adjustment of the thruster tube 73 can be effected against the blade 21 and then further fine adjustment of the thruster can be effected by controlling the pressure exerted by the inflateable tube 73 against the blade 21 for attaining the precise loading of the tip of the blade 21 at the nip 20 with the web W on the backing roll 7.

Figure 2:
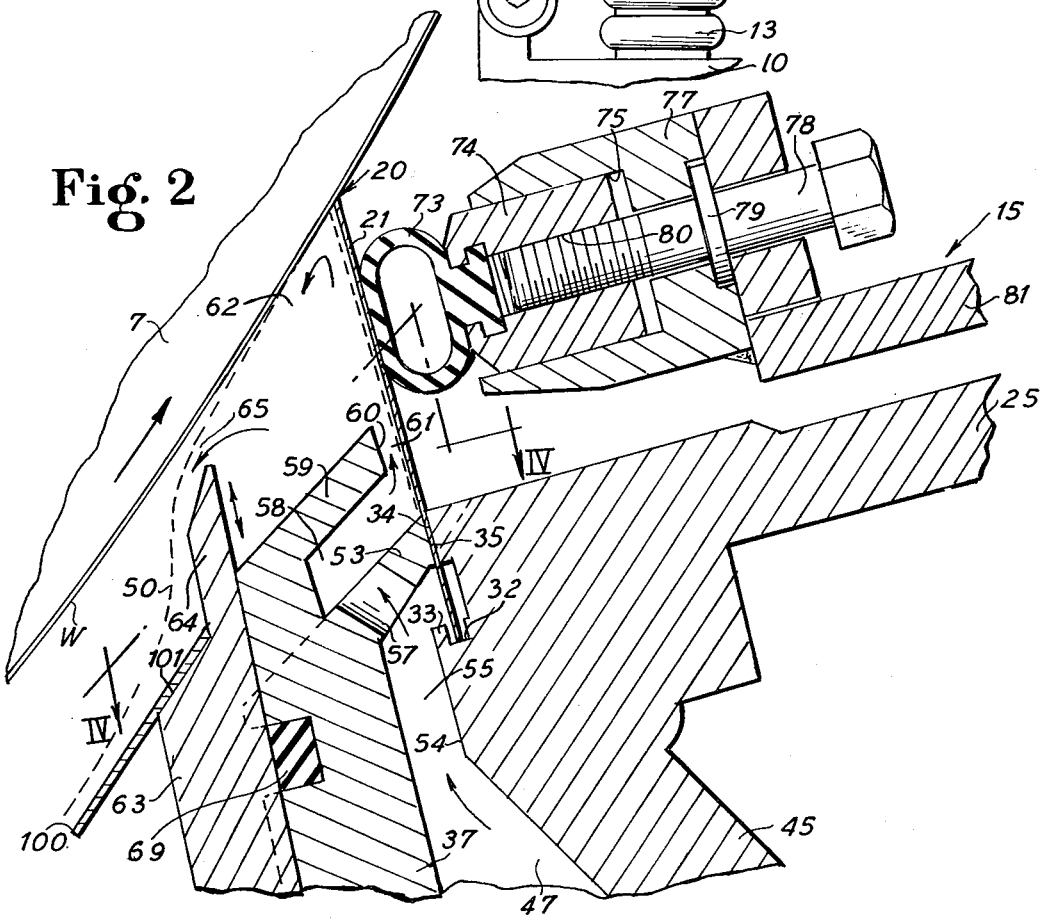
FIG. 2 is a substantially enlarged fragmentary vertical sectional detail view showing details of the coating applicator doctor blade and associated elements in the operating mode.

Another desirable feature of the thruster 73 is to maintain a desired adjustment of the orifice 61 by resiliently flexing the blade 21 as may be preferred for attainment of a desired web coating result. For optimum results in this regard, the head 77 is mounted on rocker arm means 81 which is intermediately rockably mounted as by means of ear or clevis structure attached by pivot means 83 to upper portions of rigid upstanding bracket structure 84 on top of the beam body 25. Means are attached to the rear end of the rocker arm 81 for rockably adjusting the arm to locate the thruster 73 at a desired optimum location up and down along the blade 21 and relative to its upper edge. Such adjusting means desirably comprise a downwardly extending threaded link 85 pivotally connected at its upper end by means of a pivot 87 to a knuckle clevis 88 on the lever or rocker bar 81. Longitudinal adjustments of the link 85 are adapted to be effected by means of a gear type servo device 89 connected as by means of a pivot 90 to a clevis structure 91 rigidly mounted on the back of the beam body 25. A digitally operable adjustment knob or wheel 92 is operable to shift the link 85 longitudinally as desired for rocking the arm 81 and thus adjustably locating the thruster 73 at the desired location up or down along the back of the blade 21. Various adjustment parameters of the blade pressure at the nip 20, of the width of the orifice 61 and the relationship of one to the other are thus readily attainable by operation of the various adjustment devices related to the coater head 15 and including the rocker arm 81 and the adjustment links 23. By way of example, one adjustment of the blade 21 is shown in FIG. 2 in full outline and another adjustment attainable by virtue of the flexible resiliency of the blade 21 is shown in dash outline in FIG. 2.

In order to accomodate doctor blades 21 of different widths, mounting of the coater head 15 on the arms 27 is desirably effected in a manner to permit relative up and down adjustments of the beam body 25 relative to the arms 27. To this end, each opposite end of the beam body 25 has an abutment boss 93 in overlying spaced relation to an abutment 94 on the inner side of the adjacent supporting arm 27. Extending between the abutment 93 and a shoulder 95 on the abutment 94 is, in each instance, a minipulatable adjustment device 97 by which the beam body 25 can be raised or lowered relative to the shoulder 95 for thus accomodating blades 21 of various widths. Guidance of the beam body 25 relative to the arms 27 is desirably effected by means of a keyway in a respective plate 98 at each end of the beam body 25 engaging with a key 98 fixed to the abutment 94 and thus rigid with the respective arm 27.

For diverting excess coating material 50 from the orifice 65 (FIGS. 1, 2 and 3) into a collecting pan 99 located below the backup roll 7, a baffle plate 100 is secured to the plate 63 on a shoulder 101 at the base of the upstanding orifice edge flange 64, the baffle sloping downwardly over the top of the arm 38. From the pan 99, the coating material received therein may be returned to the reservoir 51 for recycling. To protect the mechanism associated with the arm 38 against intrusion of spillover coating material, a guard panel 102 is mounted along the outer side of the arm 38.

It will be understood that suitable end dam means will be provided at the opposite ends of the coating material application chamber 62, in order to assure desired hydrostatic pressure of the coating material 50 within the chamber 62. As part of the end dam means, respective upstanding retainer flanges 103 are mounted across the opposite ends of the chambers 58 and 62, being secured in place as by means of lateral base flange means 104 and screws 105 to the top of the arm member 38. A sealing and end dam member 107 is desirably mounted in each opposite end of the chamber 58 and desirably comprises a resiliently compressible material which also has a sealing flange 108 extending into the contiguous end of the pressure drop orifice 61.

In a manner well known in this art, all of the several airsprings and pneumatic tube structures may be operatively connected in a pneumatic control system deriving compressed air from a desirable source.

It will be understood that variations and modifications may be effected without departing from the spirit and scope of the novel concepts of this invention.

I claim as my invention:

1. In a fountain coating applicator especially suitable for paper web coating and including a generally upwardly projecting doctor blade having an upper edge for coating nip relation across the width of a web travelling continuously on backing surface means, means for delivering coating material, and means extending across the width of the web for supplying the coating material from said delivering means to said coating nip, and comprising:

a first chamber defined in part by a hollow housing having an open side facing in an upstream direction relative to the travelling web and a plate member closing the open side of said housing, and the coating material from said delivering means being receivable in said first chamber;

said housing having an upwardly facing shoulder at the top of said first chamber and on which shoulder a lower edge of said doctor blade is engaged;

a second chamber in an upper end portion of said plate member and separated from said first chamber by a partition flange on said plate member along a lower side of said second chamber and having a plurality of spaced ports therethrough for effecting multiport pressure drop communication with said first chamber for thereby attaining substantially uniform distribution of the coating material throughout said second chamber;

said partition flange having a clamping surface cooperating with a clamping surface on said housing above said shoulder for securing said doctor blade in place;

a second flange on said plate member spaced above said partition flange and defining with said doctor blade and said backing surface means a third chamber adapted for presenting the coating material substantially uniformly along said blade to said coating nip;

and said second flange having an edge narrowly spaced from said doctor blade and defining with the confronting surface of said blade a slit orifice for pressure drop communication with said third chamber and adapted to direct the coating material along said blade surface toward said nip.

2. A fountain coating applicator according to claim 1, wherein said doctor blade is resiliently flexible, and means for adjusting said blade flexibly relative to said upper flange slit orifice edge.

3. A fountain coating applicator according to claim 2, wherein said means for flexing comprises a thruster, and means mounting said thruster rockably and adapted for adjusting said thruster up and down along and against the surface of said blade outside of said third chamber.

4. A fountain coating applicator according to claim 1, comprising an applicator head providing said housing and plate, and means for adjusting said head for attaining optimum coating nip relation of said blade to said web, and including means for adjusting said head for accomodating doctor blades of different widths.

5. In a fountain coating applicator especially suitable for paper webs and including a generally upwardly projecting doctor blade having an upper edge for coating nip relation across the width of a web travelling continuously on backing surface means, means for delivering coating material, and means extending across the width of the web for supplying the coating material from said delivering means to said coating nip, the improvement comprising:

means for loading said blade toward the coating nip comprising a thruster extending along the width of the blade;

and rocker means mounting said thruster enabling adjustment of said thruster up and down along the blade and relative to said upper edge.

6. A fountain coating applicator according to claim 5, wherein said rocker mounting means also includes means for adjustment of said thruster toward and away relative to said blade.

7. A fountain coating applicator according to claim 5, wherein said doctor blade is resiliently flexible, means securing a lower portion of said blade, means defining with a surface of said blade a slit orifice for controlling supplying of the coating material to said nip, said thruster being operable for resiliently flexibly adjusting said blade relative to said orifice means.

8. A fountain coating applicator according to claim 7, comprising means defining respective coating material control chambers above and below said orifice means, means defining another chamber for receiving coating material from said delivering means, and means effecting pressure drop communication between said another chamber and said chamber below said orifice means.

9. A fountain coating applicator according to claim 5, wherein said rocker means comprises a rocker arm, means intermediately pivotally supporting said arm on an axis parallel to and spaced from said blade, said thruster being carried by an end of said arm adjacent to said blade, a link attached to the opposite end of said arm, and means for adjusting said link lengthwise for adjustably moving said arm.

10. A fountain coating applicator according to claim 9, wherein said means for adjusting said link comprises a gear type servo device including digitally operable adjustment effecting means.

11. A method of coating a web travelling continuously on backing surface means, comprising:

delivering coating material to a first chamber of a fountain coating applicator;

effecting multi-port pressure drop flow of the coating material from said first chamber into a second chamber and thereby attaining substantially uniform distribution of the coating material in said second chamber;

and effecting a pressure drop of said coating material through a slit orifice along a surface of a doctor blade into a third chamber which is defined in part by said doctor blade surface and in said third chamber presenting said coating material substantially uniformly along said blade surface to a coating nip at the upper edge of said doctor blade extending across the width of said travelling web.

12. A method according to claim 11, comprising selectively controlling back pressure of the coating material in said third chamber.

13. In a fountain coating applicator especially suitable for paper webs including a generally upwardly projecting doctor blade having an upper edge for coating nip relation across the width of a web travelling continuously on backing surface means, means for delivering coating material, clamping means for receiving and clamping a lower portion along the length of said blade therebetween, and means extending across the width of the web for supplying the coating material from said delivering means to said coating nip, the improvement comprising:

said means for supplying coating material including a slit orifice defined along said blade and wherein said blade provides one side of said orifice;

an orifice surface disposed in narrowly spaced relation to said blade providing the opposite side of said orifice;

said orifice being located in spaced relation below, and directed toward, said coating nip; and said supplying means being adapted to direct the coating material under pressure through said orifice and along said blade toward said coating nip.

14. A fountain coating applicator according to claim 13, comprising means adjacent to said orifice and defining with said blade and said backing surface means a coating material chamber for receiving the coating material directed from said orifice.

15. A fountain coating applicator according to claim 14, including end dam sealing means having a portion extending sealingly into at least one end of said orifice.

16. A fountain coating applicator according to claim 15, including a supply chamber below said orifice, said supplying means causing coating material to issue from said supply chamber under pressure through said orifice, and said end dam sealing means having a portion in sealing relation in the contiguous end of said supply chamber.

17. A fountain coating applicator according to claim 16, wherein said supply chamber is defined by and between spaced flanges and said blade, one of said flanges comprising part of said blade clamping means and another of said flanges having thereon said orifice surface.

18. A fountain coating applicator according to claim 13, including pressure applying means carried on a rocker arm for adjusting the pressure of said blade toward said backing surface means, and means for rockably adjusting said arm and thereby adjusting said pressure applying means in an up and down relation on said blade.

19. A method of coating a web travelling continuously on backing surface means and including supplying the coating material from delivering means to a coating nip provided by an upper edge of an upwardly projecting doctor blade in coating nip relation across the width of said web, and controlling flow of the coating material from said delivering means to said coating nip and including subjecting the coating material to a plurality of successive pressure drops so that the coating material reaches said coating nip uniformly throughout the extent of said blade edge, the improvement comprising:

effecting the final pressure drop through a slit orifice formed in part by a surface of said doctor blade and the orifice being located in spaced relation below said coating nip; and directing the coating material substantially rectilinearly upwardly across said blade surface to said nip.

20. A method according to claim 19, comprising enhancing the uniformity of the coating material directed from said orifice to said nip by maintaining a back pressure in a coating application chamber defined in part by said blade surface and said backing surface means.

* * * * *